US011031696B2

(12) United States Patent
Xia et al.

(10) Patent No.: US 11,031,696 B2
(45) Date of Patent: Jun. 8, 2021

(54) ANTENNA-IN-PACKAGE SYSTEM AND MOBILE TERMINAL

(71) Applicant: AAC Technologies Pte. Ltd., Singapore (SG)

(72) Inventors: Xiaoyue Xia, Shenzhen (CN); Chao Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 54 days.

(21) Appl. No.: 16/705,225

(22) Filed: Dec. 6, 2019

(65) Prior Publication Data

US 2020/0212577 A1 Jul. 2, 2020

(30) Foreign Application Priority Data

Dec. 29, 2018 (CN) ..... 201811640857.4

(51) Int. Cl.

| | |
|---|---|
| ***H01Q 9/04*** | (2006.01) |
| ***H01Q 23/00*** | (2006.01) |
| ***H01Q 21/06*** | (2006.01) |
| ***H01Q 1/24*** | (2006.01) |

(52) U.S. Cl.

CPC ..... *H01Q 9/0414* (2013.01); *H01Q 1/243* (2013.01); *H01Q 21/065* (2013.01); *H01Q 23/00* (2013.01)

(58) Field of Classification Search

CPC .... H01Q 9/0414; H01Q 1/243; H01Q 21/065; H01Q 23/00

See application file for complete search history.

(56) References Cited

U.S. PATENT DOCUMENTS

2016/0056544 A1* 2/2016 Garcia ..... H01Q 1/38 343/725

* cited by examiner

*Primary Examiner* — Graham P Smith

(74) *Attorney, Agent, or Firm* — W&G Law Group LLP

(57) ABSTRACT

An antenna-in-package system and a mobile terminal are provided. The mobile terminal includes a screen, a back covering, connected to, and fitting with the screen to form a receiving space, and a main board interposed between the screen and the back cover. The antenna-in-package system includes a substrate provided between the screen and the back cover, a metal antenna provided on a side of the substrate facing away from the main board. The metal antenna includes a first antenna and a second antenna that are stacked, and the first antenna is provided on a side of the second antenna facing away from the main board. A beam of the first antenna covers a space of Y>0, and a beam of the second antenna covers a space of Z>0.

18 Claims, 7 Drawing Sheets

ANTENNA-IN-PACKAGE SYSTEM AND MOBILE TERMINAL

TECHNICAL FIELD

The present disclosure relates to the field of wireless communication technologies, and in particular, to an antenna-in-package system and a mobile terminal.

BACKGROUND

With 5G being a focus of research and development in global industry, developing 5G technologies and formulating 5G standards have become the industry consensus. The ITU-RWP5D 22nd conference held in June 2015 by International Telecommunication Union (ITU) identified three main application scenarios for 5G: enhance mobile broadband, large-scale machine communication, and highly reliable low-latency communication. These three application scenarios respectively correspond to different key indicators, and in the enhance mobile broadband scenario, the user peak speed is 20 Gbps and the minimum user experience rate is 100 Mbps. Currently, 3GPP is working on standardization of 5G technology. The first 5G Non-Stand Alone (NSA) international standard was officially completed and frozen in December 2017, and the 5G Stand Alone standard was scheduled to be completed in June 2018. Research work on many key technologies and system architectures during the 3GPP conference was quickly focused, including millimeter wave technology. Characteristics of high carrier frequency and large bandwidth that are unique to the millimeter wave are the main means to achieve 5G ultra-high data transmission rates.

The rich bandwidth resources of the millimeter wave band provide a guarantee for high-speed transmission rates. However, due to the severe spatial loss of electromagnetic waves in this frequency band, wireless communication systems using the millimeter wave band need to adopt an architecture of a phased array. Phases of respective array elements are caused to distribute according to certain rule by a phase shifter, so that a high gain beam is formed and the beam is scanned over a certain spatial range through a change in phase shift.

With an antenna being an indispensable component in a radio frequency (RF) front-end system, it is an inevitable trend in future development of the RF front-end to systematically integrate and package the antenna with an RF front-end circuit while developing the RF circuit towards integration and miniaturization. The antenna-in-package (AiP) technology integrates, through package material and process, an antenna into a package carrying a chip, which fully balances antenna performance, cost and volume, and is widely favored by broad chip and package manufacturers. At present, companies including Qualcomm, Intel, IBM and the like have adopted the antenna-in-package technology. Undoubtedly, the AiP technology will also provide a good antenna solution for 5G millimeter wave mobile communication systems.

In the related art, since bands of 28 GHz and 39 GHz are far apart, the antenna-in-package cannot cover the two bands. Therefore, the band of 28 GHz and the band of 39 GHz belong two independent channels, which require a large area in space of a mobile phone.

Therefore, it is necessary to provide a new antenna-in-package system to solve the above problems.

BRIEF DESCRIPTION OF DRAWINGS

Many aspects of exemplary embodiment can be better understood with reference to following drawings. Components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
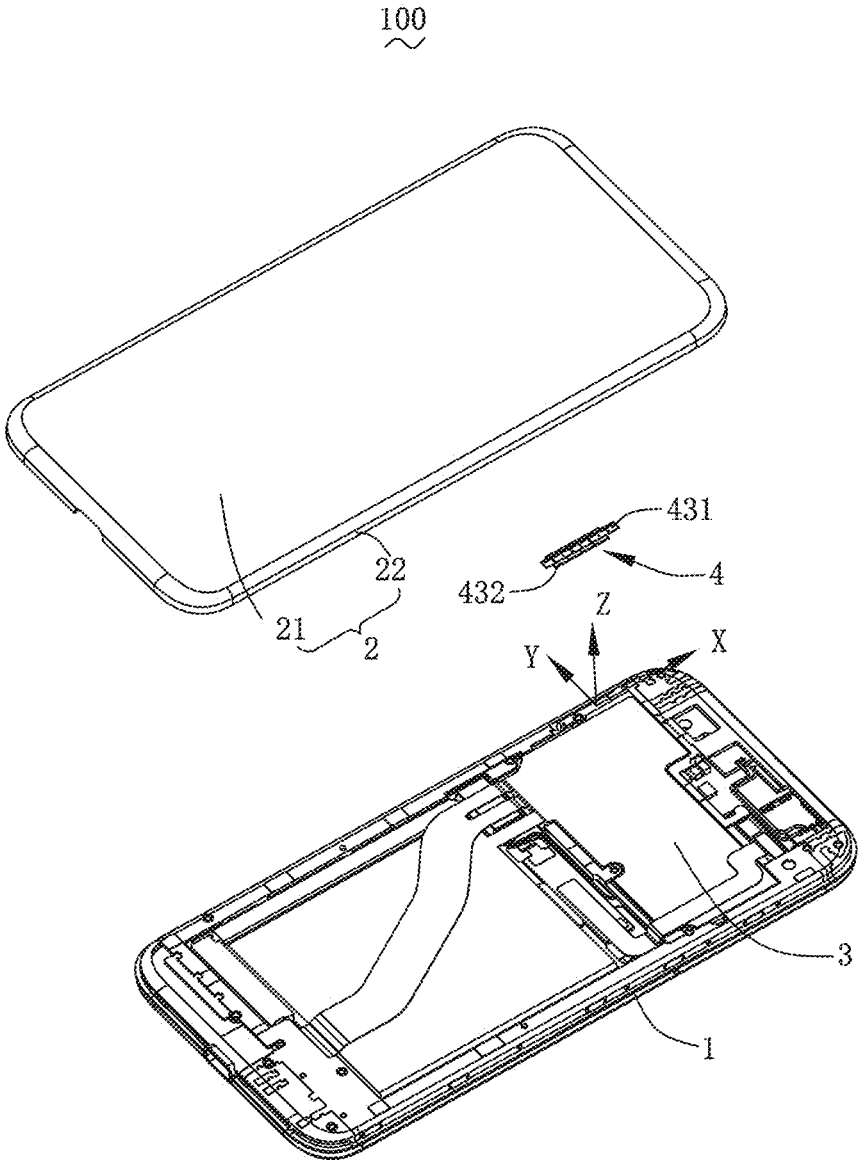
FIG. 1 is a perspective structural schematic diagram of a mobile terminal according to the present disclosure.
Figure 2:
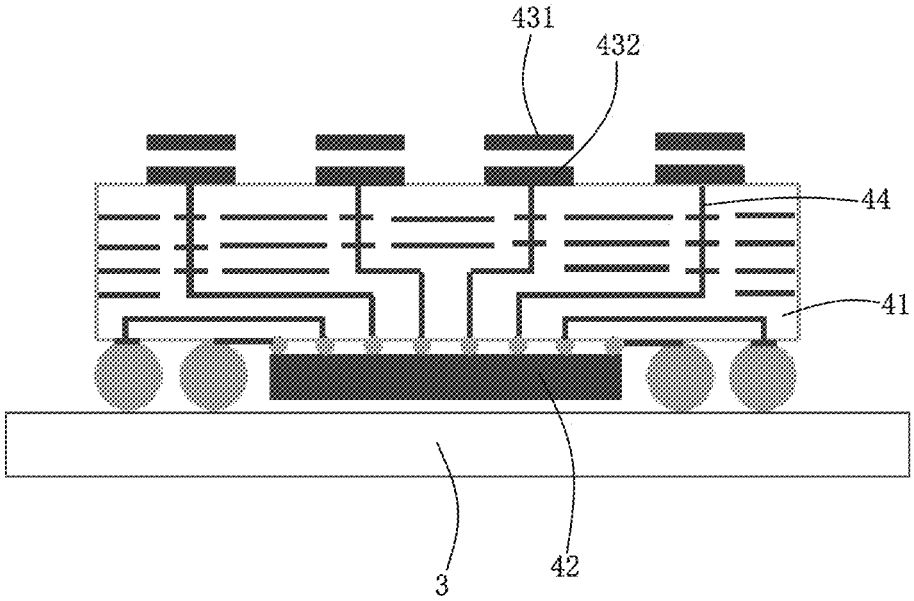
FIG. 2 is a schematic diagram showing a connection structure of an antenna-in-package and a main board shown in FIG. 1.
Figure 3:
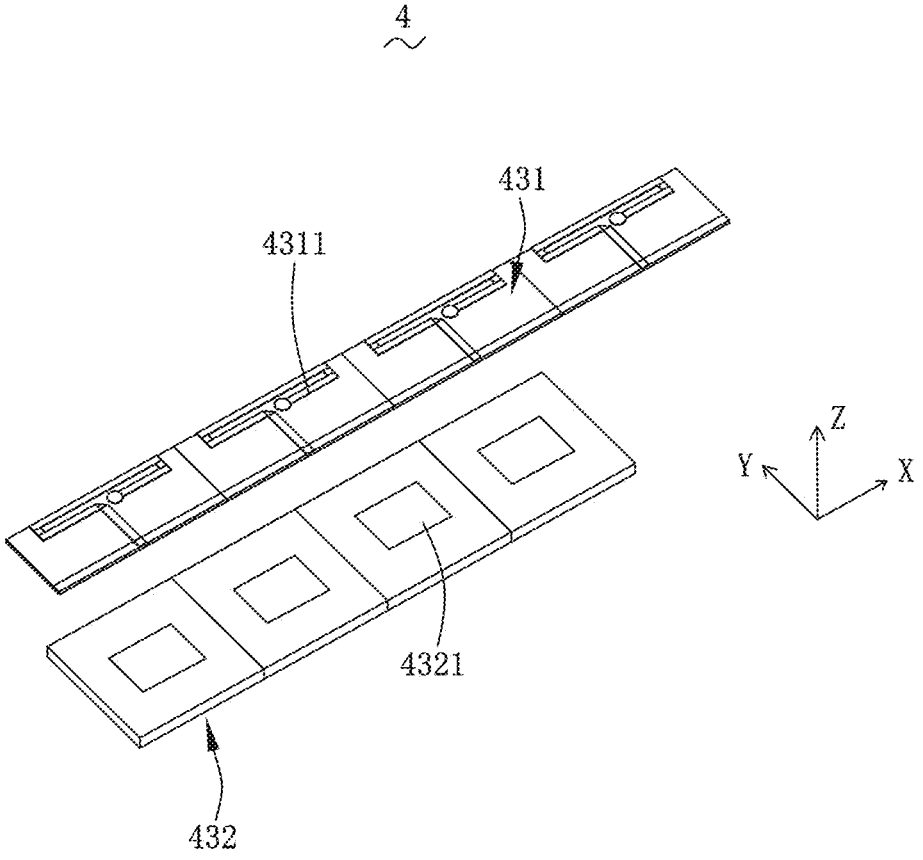
FIG. 3 is a front view of an antenna-in-package system in FIG. 1.

As shown in FIGS. 1-3, the present disclosure provides a mobile terminal 100, and the mobile terminal 100 may be a mobile phone, an ipad, a POS machine, etc., which is not limited by the present disclosure. The mobile terminal 100 includes a screen 1, a back cover 2 covering, connected to and fitting with the screen 1 to form a receiving space, a main board 3 interposed between the screen 1 and the back cover 2, and an antenna-in-package system 4 connected to the main board 3.

In order to more clearly express the content of the present disclosure, the mobile terminal 100 is positioned in a three-dimensional coordinate system in which a center point of an arrangement position of the antenna-in-package system 4 is taken as an origin. An X-axis of the three-dimensional coordinate system extends along a long axis direction of the mobile terminal 100. A Y-axis of the three-dimensional coordinate system extends along a short axis direction of the mobile terminal 100. A Z-axis of the three-dimensional coordinate system extends along a thickness direction of the mobile terminal 100. A positive axis of the Y-axis is directed to a direction facing away from the mobile terminal 100, and a positive axis of the Z-axis is directed to the back cover 2.

The back cover 2 is a 3D glass back cover that can provide better protection, aesthetics, thermal diffusion, color, and user experience. The back cover 2 includes a bottom wall 21 arranged opposite to and spaced apart from the screen 1, and a sidewall 22 being bent and extending from an outer periphery of the bottom wall 21 towards the screen 1. The sidewall 22 is connected to the screen 1, and the bottom wall 21 and the sidewall 22 are formed into one piece.

The main board 3 is received in the receiving space.

The antenna-in-package system 4 is provided adjacent to the sidewall 22 and parallel to the bottom wall 21. The antenna-in-package system is configured to receive and transmit electromagnetic wave signals, thereby implementing a communication function of the mobile terminal 100. The antenna-in-package system 4 can be connected to the main board 3 by adopting a Ball Grid array (BGA) technology.

The antenna-in-package system 4 includes a substrate 41 provided between the screen 1 and the back cover 2, an integrated circuit chip 42 provided on a side of the substrate 41 close to the main board 3, a metal antenna 43 provided on a side of the substrate 41 facing away from the main board 3, and a circuit 44 provided in the substrate 41 and connecting the integrated circuit chip 42 with the metal antenna 43.

The substrate 41 is configured to carry the metal antenna 43 and the circuit 44. The substrate 41 may be integrally formed or layered. The integrated circuit chip 42 is fixedly connected to the substrate 41 by a bumping welding process.

The antenna-in-package system 4 is a dual-band antenna system. The metal antenna 43 includes a first antenna 431 and a second antenna 432 which are stacked. The first antenna 431 is provided on a side of the second antenna 432 facing away from the main board 3. The first antenna 431 works in the band of 28 GHz. The second antenna 432 works in the band of 39 GHz. The isolation of the first antenna 431 and the second antenna 432 is better than −30 dB.

Further, the antenna-in-package system 4 is a millimeter wave phased array system, and the space occupied in the mobile phone is narrowed; and only one perspective needs to be scanned, which simplifies design difficulty, test difficulty, and beam management complexity.

The first antenna 431 is a one-dimensional linear array and includes a plurality of first antenna units 4311, and the plurality of the first antenna units 4311 is arranged at interval along the X-axis direction. The second antenna 432 is a one-dimensional linear array and includes a plurality of second antenna units 4321, and the plurality of the second antenna units 4321 is arranged at interval along the X-axis direction. Optionally, the first antenna 431 is a linear array of 1×4, that is, the first antenna 431 includes four first antenna units 4311. The second antenna 432 is a linear array of 1×4, that is, the second antenna 432 includes four second antenna units 4321.

Further, the first antenna 431 is selected from a group consisting of a dipole antenna, a monopole antenna, and a slot antenna. The second antenna 432 is selected from a group consisting of a square patch antenna, a ring patch antenna, a circular patch antenna, and a cross-shaped patch antenna. Optionally, the first antenna 431 is a dipole antenna, and the second antenna 432 is a square patch antenna. It is appreciated that, in other embodiments, the first antenna 431 and the second antenna 432 may also use antennas of other forms.

The beam of the first antenna 431 covers a space of Y>0, and the beam of the second antenna 432 covers a space of Z>0. That is, the first antenna 431 implements the beam scanning in the space of Y>0, and the second antenna 432 implements the beam scanning in the space of Z>0.

Compared to the antenna-in-package in the related art, the antenna-in-package system 4 in the present disclosure simultaneously packages the first antenna 431 and the second antenna 432 on the substrate 41 and arranges them in a stacking manner, such that the structure of the antenna system 3 becomes more compact so as to reduce the occupied space and, at the same time, the dual-band coverage of the antenna-in-package system 4 is achieved. Moreover, the antenna-in-package system 4 is formed by being laminated by a PCB process or an LTCC process, such that the size is reduced to 22×6 mm and the occupied area is greatly reduced compared to the dual-band antenna system in the related art.

Figure 4:
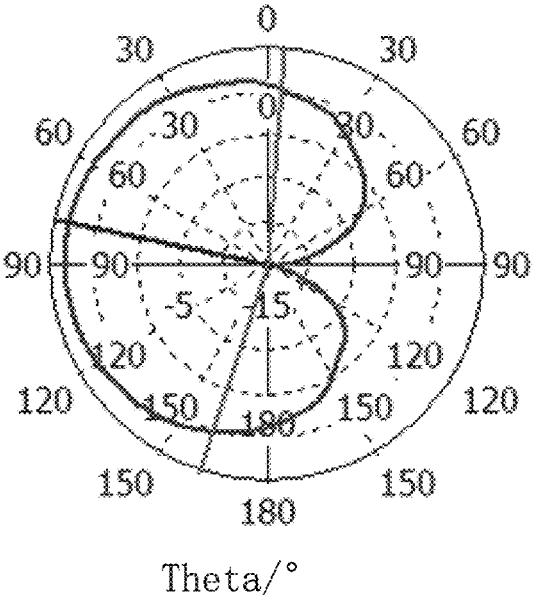
FIG. 4 illustrates a radiation pattern of a first antenna unit with a phase shift being 0° when an antenna-in-package system according to the present disclosure is in a band of 28 GHz.
Figure 5:
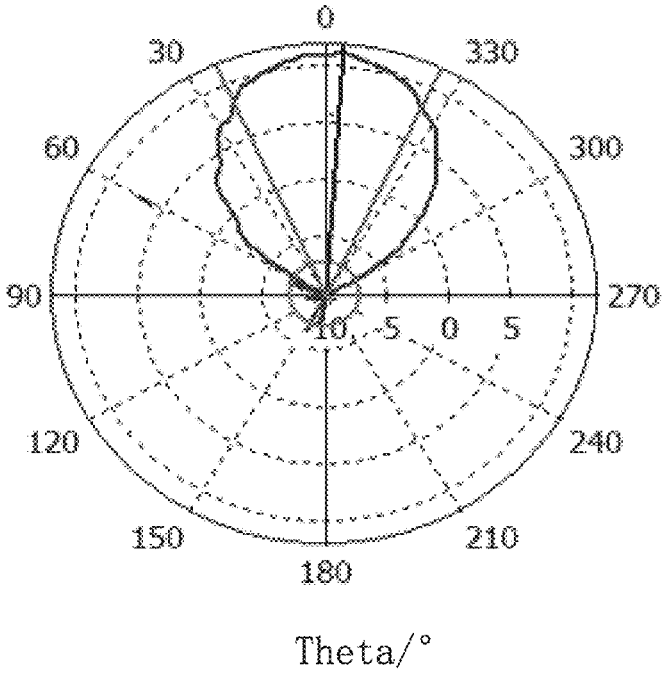
FIG. 5 illustrates a radiation pattern of a second antenna unit with a phase shift being 0° when an antenna-in-package system according to the present disclosure is in a band of 39 GHz.
Figure 6A:
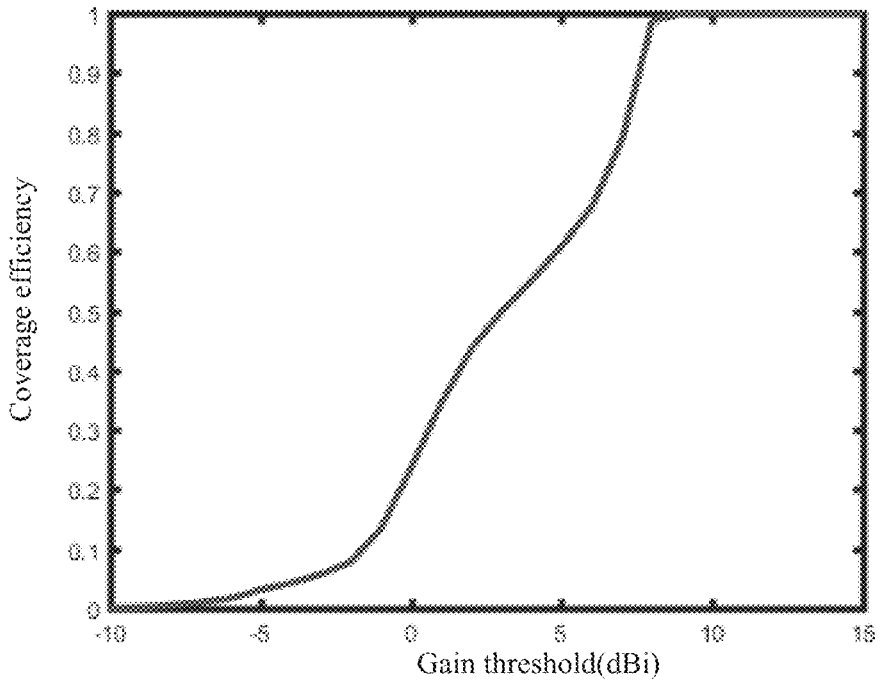
FIG. 6A illustrates a coverage efficiency graph of an antenna-in-package system according to the present disclosure in a band of 28 GHz.
Figure 6B:
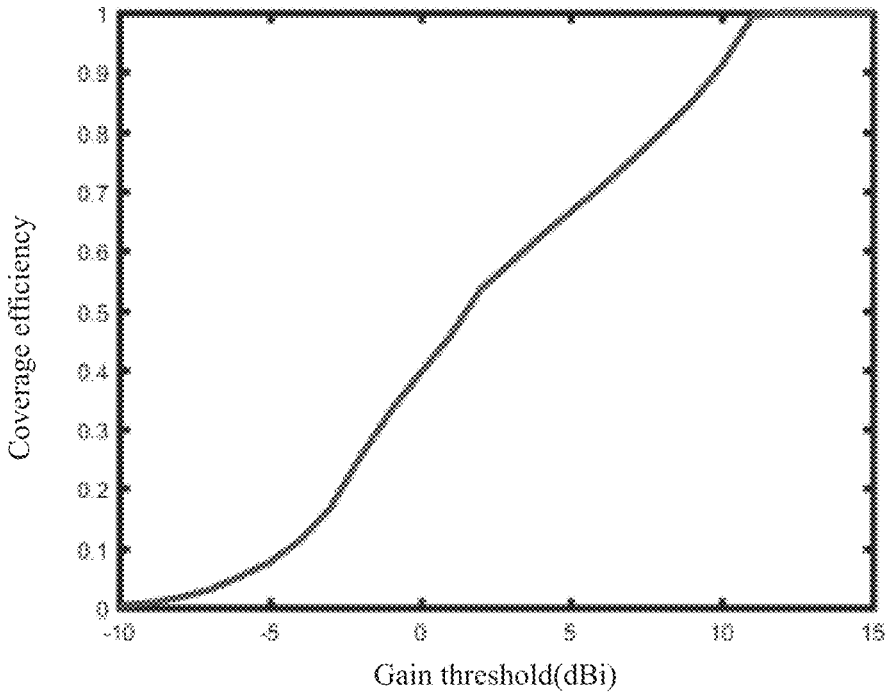
FIG. 6B illustrates a coverage efficiency graph of an antenna-in-package system according to the present disclosure in a band of 39 GHz.

Referring to FIG. 4 to FIG. 6B, in which:

FIG. 4 illustrates a radiation pattern of a first antenna unit with a phase shift being 0° when an antenna-in-package system according to the present disclosure is in a band of 28 GHz;

FIG. 5 illustrates a radiation pattern of a second antenna unit with a phase shift being 0° when an antenna-in-package system according to the present disclosure is in a band of 39 GHz;

FIG. 6A illustrates a coverage efficiency graph of an antenna-in-package system according to the present disclosure in a band of 28 GHz; and FIG. 6B illustrates a coverage efficiency graph of an antenna-in-package system according to the present disclosure in a band of 39 GHz.

It can be seen from FIG. 4 and FIG. 5 in combination, the antenna-in-package system 4 provided by the present disclosure can achieve coverage in both of the Y-direction and the Z-direction. It can be seen from FIG. 6A and FIG. 6B in combination, in the band of 28 GHz, a gain threshold of the antenna-in-package system 4 is reduced by 7 dB for the case of 50% coverage efficiency, while the gain threshold is reduced by 12.98 dB for the case of 50% coverage efficiency in the 3GPP discussion; in the band of 39 GHz, the gain threshold of the antenna-in-package system 4 is reduced by 10 dB for the case of 50% coverage efficiency, while the gain threshold is reduced by 13.6-18.0 dB for the case of 50% coverage efficiency in the 3GPP discussion, showing that the AOG antenna system 4 of the present disclosure has the better coverage efficiency.

Compared to the related art, the antenna-in-package system 4 and the mobile terminal 100 provided by the present disclosure have following beneficial effects: the antenna-in-package system 4 simultaneously packages the first antenna 431 and the second antenna 432 on the substrate 41 to achieve the dual-band coverage of the antenna-in-package system 4. Moreover, the antenna-in-package system 4 is formed by being laminated by a PCB process or an LTCC process, such that the size is reduced to 22×6 mm and the occupied area is greatly reduced compared to the dual-band antenna system in the related art. In addition, the first antenna 431 and the second antenna 432 are arranged in a stacking manner, which can further reduce the space occupied by the antenna-in-package system 4; the millimeter wave phased array antenna system adopts a linear array instead of a planar array, which occupies a narrower space in the mobile phone, and is only scanned in one perspective, thereby simplifying design difficulty, test difficulty, and beam management complexity.

What have been described above are only embodiments of the present disclosure, and it should be noted herein that those skilled in the art can make improvements without departing from the inventive concept of the present disclosure, but these are all within the scope of the present disclosure.

What is claimed is:

1. An antenna-in-package system, applied to a mobile terminal, the mobile terminal comprising: a screen, a back cover covering, connected to and fitting with the screen to form a receiving space, and a main board interposed between the screen and the back cover, wherein the antenna-in-package system comprises:

a substrate provided between the back cover and the main board;

a metal antenna provided on a side of the substrate facing away from the main board, the metal antenna comprising a first antenna and a second antenna that are stacked, and the first antenna being provided on a side of the second antenna facing away from the main board;

an integrated circuit chip provided on a side of the substrate close to the main board; and a circuit provided in the substrate and connected to the main board, the circuit connecting the metal antenna with the integrated circuit chip, wherein the mobile terminal is positioned in a three-dimensional coordinate system, the three-dimensional coordinate system having a center point of a position where the antenna-in-package system is located as an origin, an X-axis of the three-dimensional coordinate system extends along a long axis direction of the mobile terminal, a Y-axis of the three-dimensional coordinate system extends along a short axis direction of the mobile terminal, a Z-axis of the three-dimensional coordinate system extends along a thickness direction of the mobile terminal, a positive axis of the Y-axis points to a direction facing away from the mobile terminal, and a positive axis of the Z-axis points to the back cover;

a beam of the first antenna covers a space of Y>0; and a beam of the second antenna covers a space of Z>0.

2. The antenna-in-package system as described in claim 1, wherein the back cover comprises a bottom wall opposite to and spaced apart from the screen and a side wall extending from an outer periphery of the bottom wall while being bent towards the screen, and the antenna-in-package system is close to the side wall and parallel to the bottom wall.

3. The antenna-in-package system as described in claim 1, wherein the first antenna is configured to perform beam scanning in the space of Y>0, and the second antenna is configured to perform beam scanning in the space of Z>0.

4. The antenna-in-package system as described in claim 1, wherein the antenna-in-package system is a millimeter wave phased array antenna system.

5. The antenna-in-package system as described in claim 4, wherein the antenna-in-package system is a dual-band antenna system, the first antenna works in a band of 28 GHz, and the second antenna works in a band of 39 GHz.

6. The antenna-in-package system as described in claim 4, wherein the first antenna is arranged in a one-dimensional linear array and comprises a plurality of first antenna units, the plurality of the first antenna units being arranged at interval in the X-axis direction.

7. The antenna-in-package system as described in claim 4, wherein the second antenna is arranged in a one-dimensional linear array and comprises a plurality of second antenna units, the plurality of the second antenna units being arranged at interval in the X-axis direction.

8. The antenna-in-package system as described in claim 1, wherein the first antenna is selected from a group consisting of a dipole antenna, a monopole antenna, and a slot antenna.

9. The antenna-in-package system as described in claim 1, wherein the second antenna is selected from a group consisting of a square patch antenna, a ring patch antenna, a circular patch antenna, and a cross-shaped patch antenna.

10. A mobile terminal, comprising the antenna-in-package system as described in claim 1.

11. A mobile terminal, comprising the antenna-in-package system as described in claim 2.

12. A mobile terminal, comprising the antenna-in-package system as described in claim 3.

13. A mobile terminal, comprising the antenna-in-package system as described in claim 4.

14. A mobile terminal, comprising the antenna-in-package system as described in claim 5.

15. A mobile terminal, comprising the antenna-in-package system as described in claim 6.

16. A mobile terminal, comprising the antenna-in-package system as described in claim 7.

17. A mobile terminal, comprising the antenna-in-package system as described in claim 8.

18. A mobile terminal, comprising the antenna-in-package system as described in claim 9.

* * * * *